US011376651B2

(12) United States Patent
Frischkorn et al.

(10) Patent No.: US 11,376,651 B2
(45) Date of Patent: Jul. 5, 2022

(54) FLOATINGLY MOUNTED MULTI-PIECE ROLLING TOOL, AND ROLLING MACHINE

(71) Applicant: KAMAX Holding GmbH & Co. KG, Homberg (DE)

(72) Inventors: Harald Frischkorn, Homberg (DE); Hilmar Gensert, Bad Dueben (DE); Armin Jänsch, Homberg (DE); Christian Ludwig, Darmstadt (DE)

(73) Assignee: KAMAX HOLDING GMBH & CO. KG, Homberg (DE)

( * ) Notice: Subject to any disclaimer, the term of this patent is extended or adjusted under 35 U.S.C. 154(b) by 148 days.

(21) Appl. No.: 16/603,322

(22) PCT Filed: Apr. 5, 2018

(86) PCT No.: PCT/EP2018/058734
§ 371 (c)(1),
(2) Date: Oct. 7, 2019

(87) PCT Pub. No.: WO2018/189028
PCT Pub. Date: Oct. 18, 2018

(65) Prior Publication Data

US 2020/0055110 A1 Feb. 20, 2020

(30) Foreign Application Priority Data

Apr. 10, 2017 (DE) ..... 20 2017 102 146.7
Apr. 10, 2017 (EP) ..... 17165790

(51) Int. Cl.
*B21H 3/06* (2006.01)
*B21H 5/02* (2006.01)

(52) U.S. Cl.
CPC ..... *B21H 3/06* (2013.01); *B21H 5/027* (2013.01)

(58) Field of Classification Search
CPC .... B21H 3/04–048; B21H 3/06; B21H 3/065; B21H 5/027
See application file for complete search history.

(56) References Cited

U.S. PATENT DOCUMENTS 1,524,327 A * 1/1925 Wayne ..... B21H 3/06 72/90
1,979,919 A 11/1934 Wayne
(Continued)

FOREIGN PATENT DOCUMENTS

CN 204159803 U 2/2015
CN 204413013 6/2015
(Continued)

OTHER PUBLICATIONS

PCT Search Report in co-pending, related PCT Application No. PCT/EP2018/058734, dated Jul. 11, 2018.

*Primary Examiner* — Gregory D Swiatocha
*Assistant Examiner* — Bobby Yeonjin Kim
(74) *Attorney, Agent, or Firm* — Thomas | Horstemeyer, LLP

(57) ABSTRACT

A rolling tool (5) has a basic body (6) for fastening the rolling tool (5) in a rolling machine (1) and a profiled part (7) for the shaping treatment of a workpiece (2) to be rolled. The basic body (6) and the profiled part (7) are of multi-piece design. The basic body (6) and the profiled part (7), in their interconnected position, are mounted movably relative to one another in a plane perpendicular to the rolling direction (23). The basic body (6) of the rolling tool (5) can also be part of the rolling machine (1).

10 Claims, 15 Drawing Sheets

(56) References Cited

U.S. PATENT DOCUMENTS

| | | | | | |
|---|---|---|---|---|---|
| 3,733,867 | A | * | 5/1973 | Prutton | B21H 9/02 72/93 |
| 3,930,392 | A | * | 1/1976 | Matej | B21D 3/16 72/92 |
| 4,016,738 | A | | 4/1977 | Puchko et al. | |
| 4,798,070 | A | | 1/1989 | Hlavaty | |
| 6,012,364 | A | | 1/2000 | Peterson et al. | |

FOREIGN PATENT DOCUMENTS

| | | | |
|---|---|---|---|
| CN | 204430098 | U | 7/2015 |
| CN | 205763578 | U | 12/2016 |
| EP | 2570206 | A1 | 3/2013 |
| GB | 384944 | A | 12/1932 |
| GB | 1282747 | A | 7/1972 |
| GB | 1403644 | A | 8/1975 |
| JP | 50-41183 | | 8/1948 |
| JP | S5671540 | A | 6/1981 |
| JP | S58-179953 | U | 5/1982 |
| JP | S59-175447 | U | 5/1983 |
| JP | S60124432 | A | 7/1985 |
| JP | H02284735 | A | 11/1990 |
| JP | 2016022535 | A | 2/2016 |
| KR | 100819470 | B | 3/2008 |
| WO | 2004094105 | A1 | 11/2004 |

* cited by examiner

FLOATINGLY MOUNTED MULTI-PIECE ROLLING TOOL, AND ROLLING MACHINE

CROSS REFERENCE TO RELATED APPLICATION

This application is the 35 U.S.C. § 371 national stage application of PCT Application No. PCT/EP2018/058734, filed Apr. 5, 2018, which application claims the benefit of European Application No. EP 17165790.1 filed Apr. 10, 2017 and German Application No. DE 202017102146.7, filed Apr. 10, 2017, all of which are hereby incorporated by reference herein in their entireties, including any figures, tables, nucleic acid sequence, amino acid sequences, or drawings.

TECHNICAL FIELD OF THE INVENTION

The invention relates to a rolling tool having a basic body for fastening the rolling tool in a rolling machine and a profiled part for the shaping treatment of a workpiece to be rolled.

Such rolling tools serve for the production of certain outer contours of rotationally symmetrical components. The outer contours thus produced are particularly threaded portions and other profilings, such as helixes, for example. The components are particularly screws, threaded bolts, ball pins, etc.

Prior to the shaping treatment of the workpiece to be rolled, the blank is produced. This production of the blank usually occurs by forming and in particular by cold extrusion. The subsequent shaping treatment occurs by forming and in particular by cold forming.

PRIOR ART

A rolling tool having a basic body for fastening the rolling tool in a rolling machine and a profiled part for the shaping treatment of a workpiece to be rolled is known from U.S. Pat. No. 1,524,327. The basic body and the profiled part are of multi-piece design. The profiled part has a considerable thickness and is thicker by a multiple than the plate-like basic body. The profiled part is fixedly connected to the basic body by means of screw connections. The plate-like basic body is guided in a form-fitting manner, but with play, in two grooves in the mount of the rolling machine for the basic body. The grooves form undercuts. As a result, the overall rolling tool is mounted movably relative to the rolling machine in a plane perpendicular to the rolling direction.

A rolling tool having a basic body for fastening the rolling tool in a rolling machine and a profile-imparting portion for the shaping treatment of a workpiece to be rolled is known from U.S. Pat. No. 1,979,919. The overall rolling tool is held in a defined position on an assigned mount of the rolling machine by means of two oppositely acting springs. The rolling tool is movable to a limited degree counter to the spring forces. Here, the rolling tool is permanently pressed back into its starting position by virtue of the spring forces.

A rolling tool having a basic body for fastening the rolling tool in a rolling machine and a profiled part for the shaping treatment of a workpiece to be rolled is known from German Patent Application DE 102 12 256 A1. The basic body and the profiled part are of multi-piece design. The profiled part has a pronouncedly changing thickness. A plurality of screw connections are present for connecting the parts. Here, screws are screwed through through-holes in the basic body into threaded holes in the profiled part.

A further rolling tool having a basic body for fastening the rolling tool in a rolling machine and a profile-imparting portion for the shaping treatment of a workpiece to be rolled is known from German Patent Application DE 195 20 699 A1. The rolling tool can be of segmented design such that it has a plurality of profile-imparting portions. Here, the various profile-imparting portions are assigned various functions. It is possible in this way for individual profile-imparting portions to be interchanged such that the resulting outer contour of the workpiece to be treated can be changed. The projecting and recessed regions forming the geometry of the profile-imparting portion have been incorporated into a block-like blank such that the basic body and the profile-imparting portion functionally result.

A further rolling tool having a basic body for fastening the rolling tool in a rolling machine and a profile-imparting portion for the shaping treatment of a workpiece to be rolled is known from German Patent Application DE 10 2004 056 921 A1. The projecting and recessed regions of the profile-imparting portion which form the geometry of the profiled part have been incorporated into a block-like blank such that the basic body and the profiled part functionally result.

A further rolling tool having a basic body for fastening the rolling tool in a rolling machine and a profile-imparting portion for the shaping treatment of a workpiece to be rolled is known from German Patent DE 10 2004 014 255 B3. The tracking error force present by virtue of an unwanted offset between the rolling tools of the pair of rolling tools is measured by means of a sensor. The sensor signal is then fed as a control variable into a control circuit. The alignment between the rolling tools, of which one is fixed and one is movable, is changed in dependence on the sensor signal.

Further rolling tools are known from German Patent DE 10 2004 014 255 B3, European Patent EP 1 529 579 B1 and PCT Application WO 2011/059658 A1.

A punching machine having a movable punching plate and a method for the releasable fastening of a punching counterplate by means of negative pressure are known from German Patent Application DE 36 20 853 A1.

OBJECT OF THE INVENTION

The object on which the invention is based is to substantially reduce the costs involved within the context of the reconditioning of a worn rolling tool and at the same time to improve the quality of the outer contour of the workpiece that is produced by rolling.

ACHIEVEMENT

The object of the invention is achieved according to the invention by the features of the independent patent claims.

Further preferred embodiments according to the invention can be found in the dependent patent claims.

DESCRIPTION OF THE INVENTION

The invention relates to a rolling tool having a basic body for fastening the rolling tool in a rolling machine and a profiled part for the shaping treatment of a workpiece to be rolled. The basic body and the profiled part are of multi-piece design and designed such that they can be connected to one another and nondestructively separated from one another. The basic body and the profiled part, in their interconnected position, are movably mounted relative to one another in a plane perpendicular to the rolling direction.

The invention further relates to a profiled part for a rolling tool having a profile-imparting portion for the shaping treatment of a workpiece to be rolled. The profiled part has a connecting portion for connection to a separate basic body of the rolling tool. The basic body has a fastening portion for fastening in a rolling machine and a connecting portion for connection to the profiled part, wherein the profiled part has no fastening portion for fastening in the rolling machine. The two connecting portions, in their interconnected position, are mounted movably relative to one another in a plane perpendicular to the rolling direction.

The invention further relates to a profiled part as claimed in claim 12.

The invention further relates to a rolling machine as claimed in claim 14 and to a rolling machine as claimed in claim 15.

For the desired shaping treatment of the workpiece to be rolled, the latter is brought into contact with a pair of rolling tools. Where mention is made in this application of a rolling tool, this refers to one of these rolling tools of the pair of rolling tools and not to the complete pair.

If the rolling tools are rolling jaws, one of the rolling jaws is generally firmly clamped in the rolling machine. The second rolling jaw is fastened to a movable mount—in particular a carriage—of the rolling machine. It usually has a greater length and is guided past the fixed rolling jaw at a defined distance—the so-called rolling nip. The workpiece to be rolled is introduced into this rolling nip. The rolling jaws each have the profile-imparting portion on their lateral surface facing the workpiece.

The movable mounting between basic body and profiled part constitutes a floating mounting. The floating mounting is particularly realized on the fixed rolling jaw. However, additionally or alternatively, it can also be realized on the movable rolling jaw. It is particularly present only on one rolling jaw. The same correspondingly applies to other designs of rolling tools, in particular rollers, rings or ring segments. Even if the floating mounting is realized only on one rolling jaw or another rolling tool, the other rolling jaw or the other rolling tool can have a separate thin profiled part. Consequently, the advantages of easy interchangeability and material and cost saving are also utilized independently of the floating mounting.

The new at least two-part rolling tool with a floating mounting between the basic body and the profiled part allows the rolling operation to be optimized in multiple respects. Here, the optimization relates both to the costs involved in the context of reconditioning a worn rolling tool and the quality of the outer contour of the workpiece that is produced by rolling. In this way, too, the costs involved within the context of the overall rolling operation are reduced.

As comprehensively described for example in the aforementioned German Patent DE 10 2004 014 255 B3, a misalignment of the profile-imparting portions of the rolling tools of the pair of rolling tools with one another results in an undesired tracking error force.

This tracking error force is now used according to the invention to apply the translational degree of freedom provided by the floating mounting for the correcting self-alignment of the rolling tools.

By making possible a relative movement between the basic body and the profiled part in their interconnected position in a plane perpendicular to the rolling direction, they can utilize the tracking error force present during rolling in order to align themselves relative to one another and to optimize the position of the profiled part of one rolling tool relative to the profiled part of the other rolling tool.

This new movable mounting, namely mounting with a translational degree of freedom, mounting with a desired play or else floating mounting, does not relate to the plane in which the rolling direction is located. The rolling forces have to be transmitted in the plane of the rolling direction, with the result that such a floating mounting is not suitable there. This movable mounting relates rather to a plane extending perpendicular to the rolling direction, as is illustrated for example in FIGS. 6, 7 and 8. This mounting serves to allow a profiled part of one rolling tool or both profiled parts of the rolling tools to have a limited movement in this plane in order to reach the ideal relative position or at least to approach said position. This is automatically achieved by making possible the relative movement, since the rolling forces in this ideal position are lowest and the profiled part therefore automatically assumes said position if it has the corresponding movability.

The basic body and the profiled part, in their interconnected position, are movably mounted relative to one another in the plane perpendicular to the rolling direction preferably along only one axis, namely a movement axis Z. The profiled part has a length L and a width B, wherein the rolling direction extends parallel to the length L of the profiled part, and the movement axis Z extends parallel to the width of the profiled part. The rolling direction is strictly speaking the rolling sense of direction, since the rolling direction indicates not only a position in space but is also directional. The floating mounting concerns instead a movability in two opposite senses of direction along an axis, that is to say back and forth.

This can also be described in such a way that the movement axis Z corresponds to the longitudinal axis of a workpiece to be rolled which is received in the rolling tool 5. If the workpiece is a screw, for example, the movement axis Z thus corresponds to the screw longitudinal axis.

The basic body and the profiled part, in their interconnected position, are movably mounted relative to one another in a plane perpendicular to the rolling direction while exclusively overcoming the static friction between them. This means in particular that the basic body and the profiled part are movably connected to one another in such a way that, after a relative movement, they are not urged back into a starting position by a resetting means, for example a spring. Instead, they can freely assume and maintain their ideal relative position with respect to one another.

Before the rolling of the first workpiece, there particularly occurs at first a coarse manual prealignment between profiled part and basic body, for example by means of stops or adjusting devices. They are then removed before the rolling of the first workpiece.

The first workpiece is then rolled. There automatically occurs here an alignment of the movable profiled part relative to the basic body along the movement axis Z. There thus occurs an alignment to the working point. If the difference between the presetting and the working point were too large, the first workpiece would be a reject.

In the case of the following workpieces, the rolling operation now begins from the working point. There thus occurs no return into a starting position. However, given the still present movability along the movement axis Z (i.e. back and forth), the rolling tool can further adapt to the geometric conditions which change somewhat from workpiece to workpiece. Here, only the static friction between the movable profiled part and the basic body has to be overcome. The force required for this is provided by the rolling operation.

The automatic adjustability is particularly facilitated by the fact that, on account of its small thickness, the profiled part has a small mass and thus also a small mass inertia. Furthermore, the applied holding forces can be small, with the result that overall only a small force has to be applied to overcome the static friction.

This movable or floating mounting is thus not to be understood as a mounting which, only on account of unavoidable tolerances or other unwanted errors, does not achieve the fixed mounting desired per se. In order also to delimit the invention numerically from such random degrees of freedom, the degree of the movability along only one axis, namely the movement axis, in the plane perpendicular to the rolling direction can be at least 0.1 mm, in particular between 0.1 mm and 0.3 mm, in particular between 0.1 mm and 0.2 mm, in particular approximately 0.1 mm.

To allow this translational degree of freedom, no stop is present within the area required for the movement. However, for the correct placement of the profiled part on the basic body, there can be provided a stop which is situated outside this area required for the self-alignment. However, this stop has no function during the rolling operation.

The holding force between the basic body and the profiled part that is provided by the connecting means can be designed to be adjustable. Additionally or alternatively, this holding force can be designed to be deactivatable in order to make it possible in a simple manner to change a worn profiled part or profiled part which is to be interchanged for other reasons.

The separate production and multi-piece design of the rolling tool within the sense of a structural division into the basic body and the profiled part achieves many advantages. These also surprisingly include a substantial cost reduction within the context of maintaining the rolling tool.

As in other tools too, rolling tools are subject to a certain degree of wear during use. In the case of rolling tools, this wear occurs in the region of their profiled surface for the shaping treatment of the workpiece. If this profile-imparting portion is worn to such an extent that proper treatment of the workpieces to be rolled is no longer possible, a restoring post-treatment must take place. Since the user of the rolling tool is usually not technically capable of this, the rolling tool is sent back to the rolling tool manufacturer by post or freight forwarder. Since a rolling tool has a considerable mass which, depending on the size, can be for example between approximately 0.5 and 50 kg, considerable freight costs arise by this sending of the rolling tool back and forth.

This problem is now solved or substantially reduced according to the invention by virtue of the fact that the rolling tool is divided into two parts, namely a basic body and a profiled part, and these parts are handled differently. Since, in the normal case during the use of the rolling tool, the basic body is subject to at least no appreciable wear, if any, it can remain with the user of the rolling tool. To prepare for the maintenance, the profiled part is thus separated from the basic body and only the profiled part is sent to the maintainer. As a result, the mass and the volume of the part to be dispatched and hence the freight costs are substantially reduced.

Furthermore, the multi-piece nature of basic body and profiled part means that they can be formed from different materials and/or can be subjected to different treatment processes. Thus, it is possible for example to produce the basic body from a comparatively less high-grade and hence more cost-effective material. The basic body can consist of structural steel, for example. The profiled part preferably consists of a higher-grade, harder and more wear-resistant material. This can be, for example, hard metal or high-speed steel (HSS).

In the case of the new rolling tool, a substantial volume fraction can thus act only as carrier material with correspondingly reduced material requirements. By contrast, the volume fraction of the actual functional part—namely the profiled part—is reduced and can meet higher material requirements in an economical manner.

Although the basic body and the profiled part are produced separately as separate parts, they are tailored to one another in such a way that they can be joined together to form the rolling tool. This joining together occurs such that the subsequent separation is possible nondestructively.

The profiled part can be formed as a threaded rolling part with a pitch, and the degree of the movability along only one axis, namely the movement axis, in the plane perpendicular to the rolling direction can be at least 5%, in particular at least 8%, in particular at least 10%, in particular between 5% and 15%, in particular approximately 10% of the pitch. Otherwise, the problem exists that a plurality of tracks are produced and thus a faulty thread is rolled.

In the operating position of the rolling tool in the rolling machine, the basic body and the profiled part can be designed such that they can be connected to one another by negative pressure, magnetism or spring force. The desired floating mounting is realized by these non-positive connection techniques and at the same time the required pressing force is achieved.

The profiled part can have a smaller thickness than the basic body and/or of 10 mm or less. Consequently, the mass of the profiled part which is to be sent for maintenance or else is to be replaced completely is substantially reduced. The thickness of the profiled part is preferably chosen such that the desired number of maintenance measures is possible. During maintenance, the worn profile-imparting portion is either partially or completely removed and a new intact profile-imparting portion is incorporated. This understandably results in a reduction in the height of the profiled part. The starting height of a new profiled part is thus preferably chosen such that the thickness of the profiled part is also still then sufficient for the proper function of the rolling tool after the desired number of maintenance measures has been carried out. The maintenance measure is particularly a regrind.

Here, the thickness of the profiled part is preferably chosen such that said thickness can take up the rolling forces occurring during the rolling operation in the rolling direction with the required security without being deformed or even broken.

However, it is also possible that a worn profiled part is not restored but is replaced by a new profiled part. The two rolling tools are arranged at a defined distance from one another—the so-called rolling nip—in the rolling machine. The workpiece to be rolled is introduced into this rolling nip. If the rolling tools are repaired, the thickness of the rolling tool decreases, with the result that the rolling nip changes and has to be reset. If thus a worn profiled part is not restored but is replaced by a new profiled part, the setting-up effort in the sense of setting the rolling nip occurs only once.

The thickness of the profiled part can be at most approximately half the thickness of the basic body. This ensures that a sufficiently large number of maintenance measures can be carried out and at the same time the desired mass and weight reduction of the profiled part to be interchanged is achieved.

A greatly reduced thickness of the profiled part can also be referred to as a "rolling sheet".

The profiled part thus has a comparatively small maximum thickness. Here, the maximum thickness of the profiled part is to be understood as the thickness at its thickest point. The profiled part frequently has an approximately uniform thickness over its length and width, with the result that said thickness corresponds at the same time to the maximum thickness. However, if the profiled part has a thickness which changes in cross section and/or longitudinal section (as is the case for example in the prior art according to DE 102 12 256 A1), this is thus the region of its greatest thickness. Reducing the thickness of the profiled part at its thickest point results in the desired material saving.

The maximum thickness of the profiled part can be between 4 mm and 10 mm, in particular between 4 mm and 8 mm. A profiled part of such thinness by comparison with the prior art leads to a substantial reduction in the costs arising within the context of repairing a worn rolling tool.

The profiled part can be arranged on the basic body as seen in the radial direction of the workpiece to be rolled. If it is thus assumed for example that the rolling tool is a parallelepiped whose upper surface is formed by the profiled part, the parting plane between basic body and profiled part extends in a plane, which is parallel to this upper surface, within the parallelepiped.

The profiled part can have a profile-imparting portion for the shaping treatment of the workpiece to be rolled and a connecting portion for connection to the basic body. Here, the basic body can have no profile-imparting portion for the shaping treatment of the workpiece to be rolled but a fastening portion for fastening in a rolling machine and a connecting portion for connection to the profiled part. The separation of basic body and profiled part thus occurs such that the shape-imparting function is assigned solely to the profiled part and the fastening function within the sense of fastening in the rolling machine is assigned solely to the basic body.

The profile-imparting portion has a profile depth. Depending on the planned maintenance measure, the thickness of the profiled part can be a multiple of the profile depth of the profile-imparting portion of the profiled part. It is in particular approximately twice the profile depth. As a rule, one profile depth is worked off with a maintenance measure.

In the operating position of the rolling tool in a rolling machine, the basic body and the profiled part can be designed such that they can be connected to one another by negative pressure. Such a negative pressure connection ensures the nondestructive separation of the two parts in a particularly simple manner. Nor does the connection of basic body and profiled part require a specific tool. It only has to be ensured that the profiled part and the basic body are inserted into the rolling machine in such a way that the negative pressure ducts present for applying the negative pressure can become effective.

The basic body and the profiled part can also be designed such that they can be connected to one another by magnetism or spring force. It is also possible to combine these connection types with one another or else with the above-described negative pressure connection.

The rolling tool can be designed as a rolling jaw. Rolling jaws are the above-described parallelepipedal, relatively flat rolling tools (see for example FIG. 7 of German Patent Application DE 10 2004 056 921 A1 of the applicant).

However, it is also possible for example that the rolling tool is formed as a roller, ring or ring segment.

If the rolling tool is formed as a roller, the core of the roller is formed by the basic body with a substantially round cross section—where appropriate with lugs, grooves, cutouts for the drive or other profilings. The outer circumferential surface of the roller has the profile-imparting portion and is part of the profiled part, which has a circular-ring-shaped cross section.

If the split rolling tool is a ring segment, the profiled part has a circular-ring-portion-shaped cross section. At least the connecting portion of the basic body is then also circular-ring-portion-shaped.

The rolling tool can for example be part of a roller/ring segment tool (see for example FIG. 8 of German Patent Application DE 10 2004 056 921 A1 of the applicant). In the case of such a roller/ring segment tool, one rolling tool is formed as a round roller and the other rolling tool is formed as a ring segment. The rolling tool can also be part of a roller/roller tool.

The profiled part of the rolling tool can be designed so as to be divided into a plurality of segments. These segments then particularly have different geometries, with the result that different geometries can be produced on a workpiece using the rolling tool. The segments are particularly formed split along the longitudinal axis of the workpiece.

The rolling tool can be assigned a movement drive. The movement drive serves to support the relative movement between the profiled part and the basic body in a motorized manner. The movement drive can in particular have a motor, in particular an electric motor, and a coupling element which is operatively connected to the profiled part. The motor drives the coupling element rotationally or translationally back and forth. This movement is transmitted by the coupling element to the profiled part and thus causes the desired translational movement of the profiled part relative to the basic body.

The movement drive can have a movement sensor unit. The movement sensor unit detects a relative movement between the profiled part and the basic body that automatically results from the rolling operation and increases said relative movement. As soon as the tracking error force is no longer present or a limit value has been undershot, the motor is switched off. If the tracking error force changes its sense of direction, the rotation sense of direction of the motor is reversed.

The invention relates not only to a complete rolling tool having a basic body and a profiled part but also to a separate profiled part for a multi-piece rolling tool. This profiled part with the profile-imparting portion is then connected via its connecting portion to a corresponding connecting portion of the basic body of the rolling tool. It is thus particularly possible that a worn profiled part is not restored but is replaced by a new profiled part. Thus, in this case, the manufacturer of the rolling tool delivers either no basic body at all or only the basic body, which remains with the user, during the first delivery of the rolling tool. In the further course, only new profiled parts are then delivered to the user of the rolling tool.

A further aspect of the invention relates to a new rolling machine which already contains the basic body of the rolling tool. Thus, in this case, the basic body can have already been delivered by the manufacturer of the rolling machine, with the result that the manufacturer of the rolling tool delivers only the profiled part. This can then again be either repaired or replaced after the occurrence of a certain degree of wear.

A further aspect of the invention relates to a new rolling machine having a negative pressure connection, magnets or a spring for achieving the fixed connection between the basic body and the profiled part of the new multi-piece rolling tool.

Advantageous developments of the invention are provided by the patent claims, the description and the drawings.

The advantages mentioned in the description of features and of combinations of multiple features are only of an exemplary nature and may come into effect alternatively or cumulatively without the advantages of embodiments according to the invention necessarily having to be achieved. With regard to the disclosure content of the original application documents and of the patent, the following applies, without the subject matter of the appended patent claims being altered as a result: further features can be taken from the drawings—in particular the geometries represented and the relative dimensions of a number of components in relation to one another and their relative arrangement and operative connection. The combination of features of different embodiments of the invention or of features of different patent claims is likewise possible in a way departing from the chosen dependency references of the patent claims, and is herewith suggested. This also applies to those features that are represented in separate drawings or mentioned in the description thereof. These features may also be combined with features of different patent claims. Similarly, features recited in the patent claims may be omitted for further embodiments of the invention.

The features mentioned in the patent claims and the description should be understood with respect to their number such that precisely this number or a greater number than the number mentioned is present, without explicit use of the adverb "at least" being required. If, therefore, mention is made for example of a profiled part, this should be understood as meaning that precisely one profiled part, two profiled parts or more profiled parts are present. These features may be supplemented by other features or be the only features of which the respective product consists.

The reference signs contained in the patent claims do not represent any restriction of the scope of the subject matter protected by the patent claims. They merely serve the purpose of making the patent claims more easily understandable.

BRIEF DESCRIPTION OF THE FIGURES

The invention is further explained and described below on the basis of preferred exemplary embodiments that are represented in the figures.

DESCRIPTION OF THE FIGURES

Figure 1:
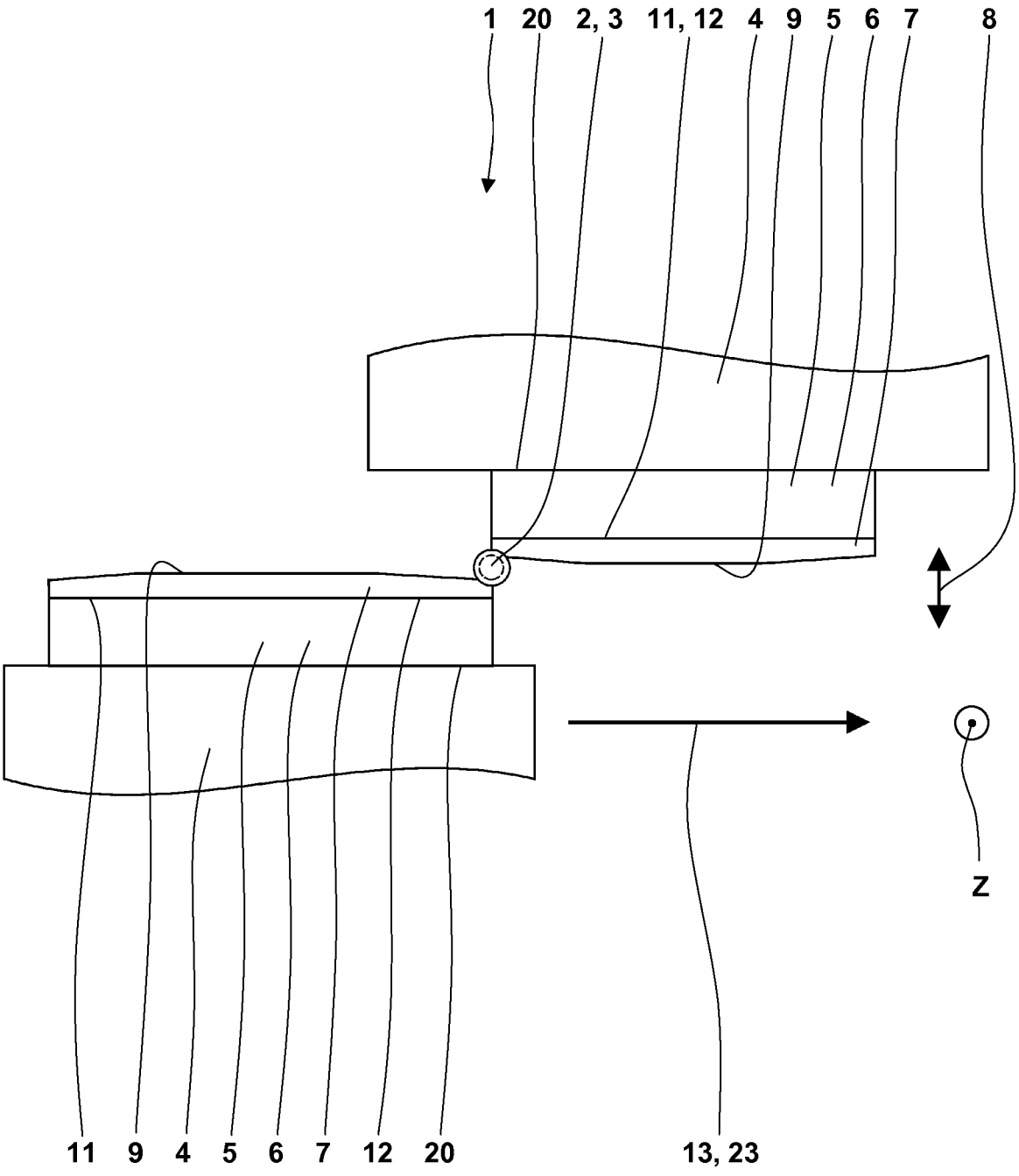
FIG. 1 shows a schematic side view of a part of a first exemplary embodiment of a new rolling machine having two rolling tools at the start of the shaping treatment of a workpiece to be rolled.

FIG. 1 shows a schematic side view of a first exemplary embodiment, which is represented only in parts, of a new rolling machine 1 for the shaping treatment of a workpiece 2 to be rolled. In the present example, the workpiece 2 is a screw 3. However, it could also be another workpiece 2 to be treated by rolling.

The rolling machine 1 has two mounts 4 which each serve for the fastening of a rolling tool 5 of a pair of rolling tools 5. In the present example, the rolling tools 5 take the form of parallelepipedal or plate-shaped rolling jaws. However, they could also have a somewhat different geometry.

Apart from the design of the rolling tools 5, the further details of this embodiment of the rolling machine 1 correspond to the prior art, and therefore a further description can be dispensed with.

The respective rolling tool 5 has a basic body 6 for fastening the rolling tool 5 to the mount 4 of the rolling machine 1. The rolling tool 5 further has a profiled part for the shaping treatment of the workpiece 2 to be rolled. The basic body 6 and the profiled part 7 have been produced as separate elements—i.e. they are of multi-piece design—and have then been connected to one another to form the rolling tool 5. In this way, the basic body 6 and the profiled part 7 are designed such that they can be connected to one another and nondestructively separated from one another.

The profiled part 7 is arranged on the basic body 6 as seen in the radial direction 8 of the workpiece 2 to be rolled.

The profiled part 7 has a profile-imparting portion 9 for the shaping treatment of the workpiece 2 to be rolled. The profile-imparting portion 9 has a profiled external geometry with projecting regions and recessed regions which correspond to the desired external geometry to be rolled of the workpiece 2. In the present illustrated example, the profile-imparting portion 9 serves for rolling the thread 10 of the screw 3. However, it could also have a different geometry and serve for rolling another outer contour.

The profiled part 7 further has a connecting portion 11 for connection to the basic body 6. The connecting portion 11 is arranged opposite to the profile-imparting portion 9 and extends substantially at a distance therefrom and parallel thereto. The basic body 6 has a corresponding connecting portion 12 for connection to the connecting portion 11 of the profiled part 7. Opposite to the connecting portion 12, the basic body 6 has a fastening portion 20 for fastening in the rolling machine 1.

In the illustrated example, the two connecting portions 11, 12 and hence the profiled part 7 and the basic body 6 are connected to one another by a connecting technique (not shown). This takes the form of negative pressure, magnetism, form-fitting and/or spring force, as will be further explained below.

In the illustrated example, the profiled part 7 has a smaller thickness than the basic body 6. It is less than half the thickness of the basic body 6.

As is symbolically illustrated in FIG. 1 by way of the arrow 13, in this case the upper rolling tool 5 is positionally fixed and the lower rolling tool 5 is movably arranged and driven in the direction of the arrow 13. Here, the arrow 13 corresponds to the rolling direction 23 (more precisely to the rolling sense of direction). During the movement of the lower rolling tool 5 in the direction of the arrow 13, the blank of the workpiece 2 is received between the profile-imparting portions 9 and correspondingly formed. This type of forming is known per se in the prior art and is therefore not further described herein in the following.

Figure 2:
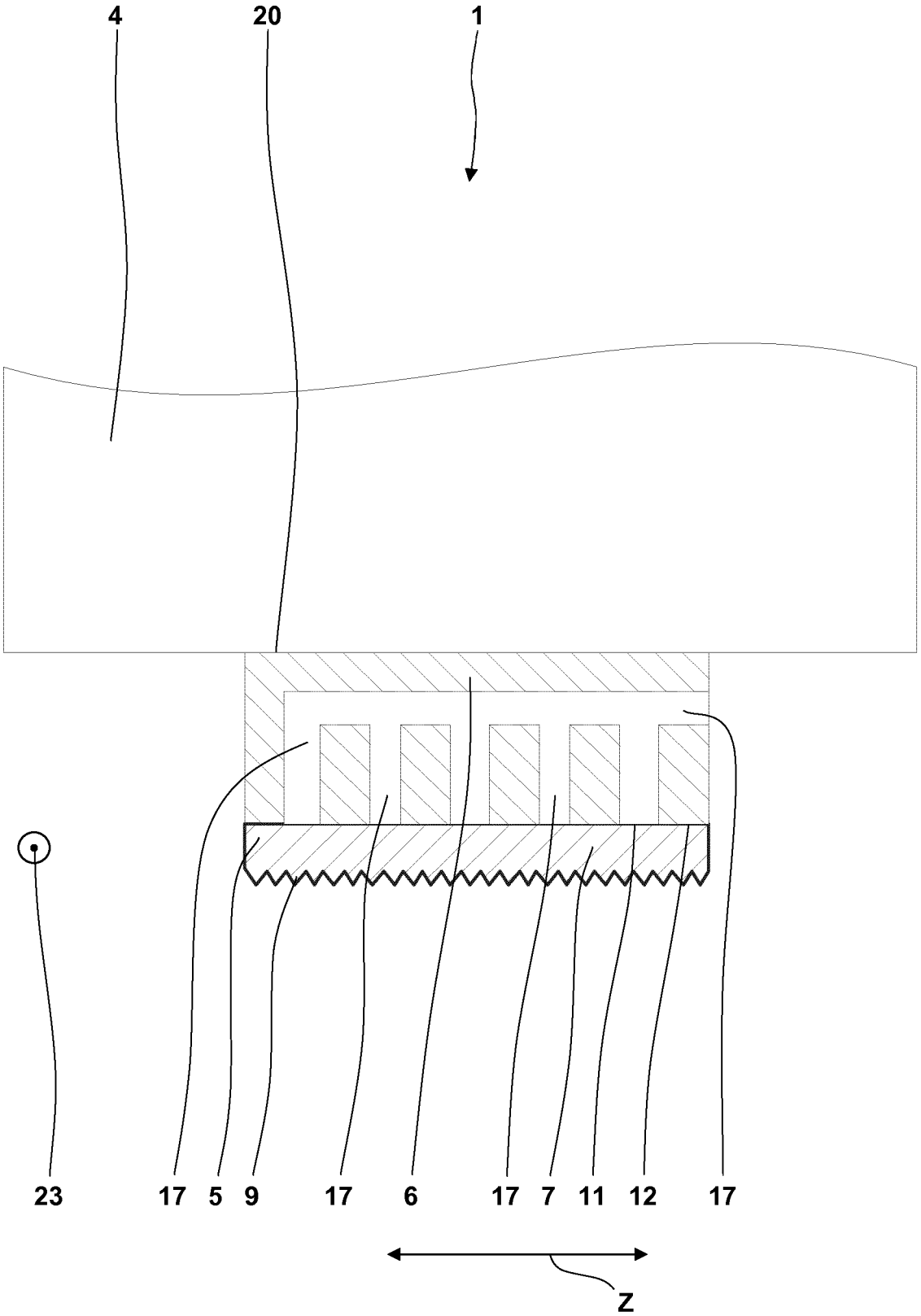
FIG. 2 shows a partially sectioned schematic view of a further exemplary embodiment of the new rolling tool having negative pressure ducts.

FIG. 2 shows a first concrete type of connection between the basic body 6 and the profiled part 7. In this case, the connection is realized by applying a negative pressure. For this purpose, the basic body 6 has one or more negative pressure ducts 17. The negative pressure ducts 17 are connected in terms of pressure to the connecting portion 11 of the profiled part 7, with the result that they exert the desired negative pressure action and the resultant connecting action on the profiled part 7.

The external geometry of the profile-imparting portion 9 is clearly evident in FIG. 2. It is further evident that the connecting portions 11, 12 are each formed as planar surfaces.

Figure 3:
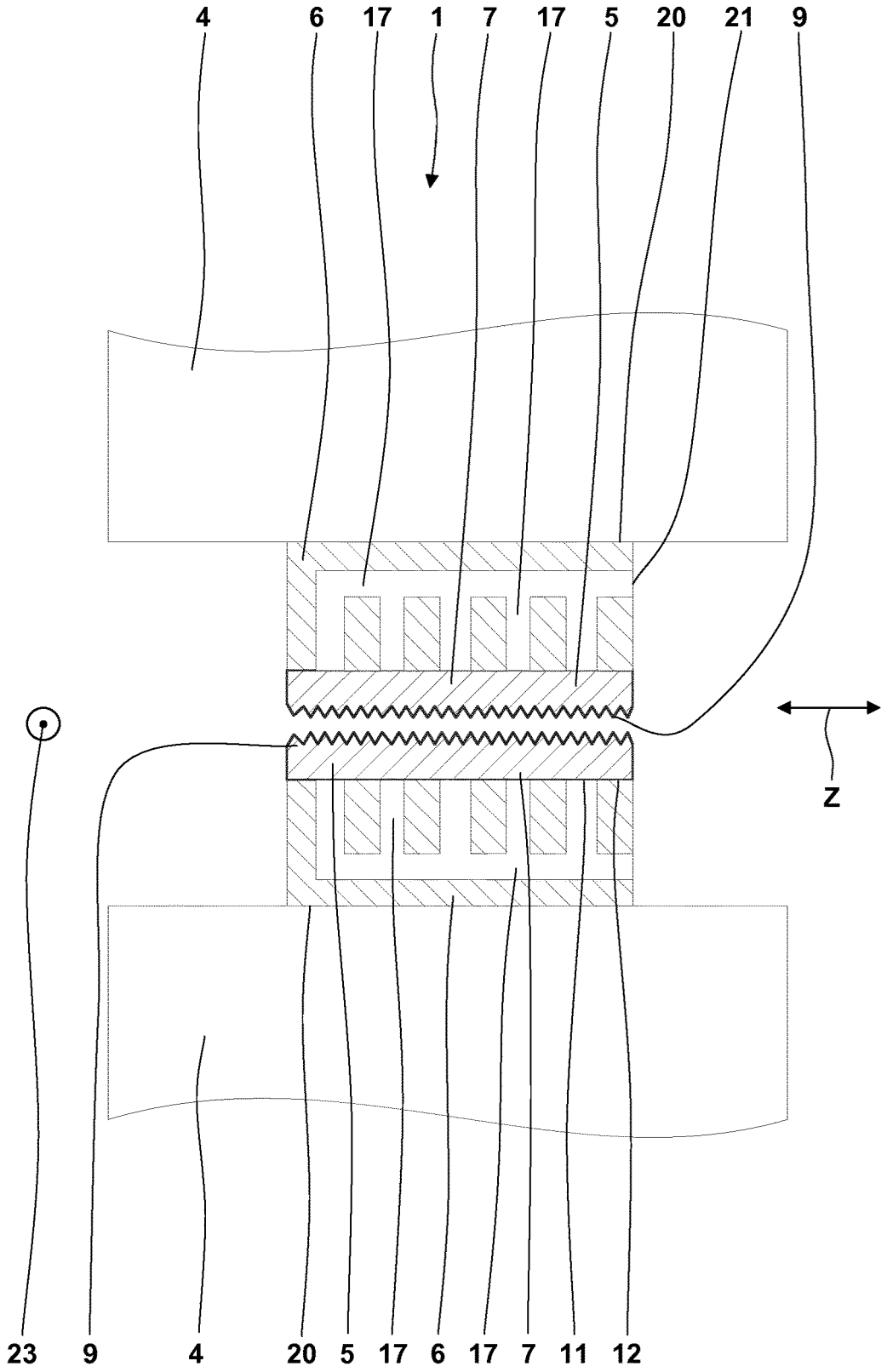
FIG. 3 shows a partially sectioned schematic view of a pair of a further exemplary embodiment of the new rolling tool having basic bodies, which are integrated into the rolling machine, with negative pressure ducts.

FIG. 3 illustrates a further embodiment of the rolling machine 1 in which the basic body 6 is part of the rolling machine 1. In this case, the connection between the connecting portions 11, 12 is again realized by means of negative pressure which prevails via the negative pressure ducts 17.

Figure 4:
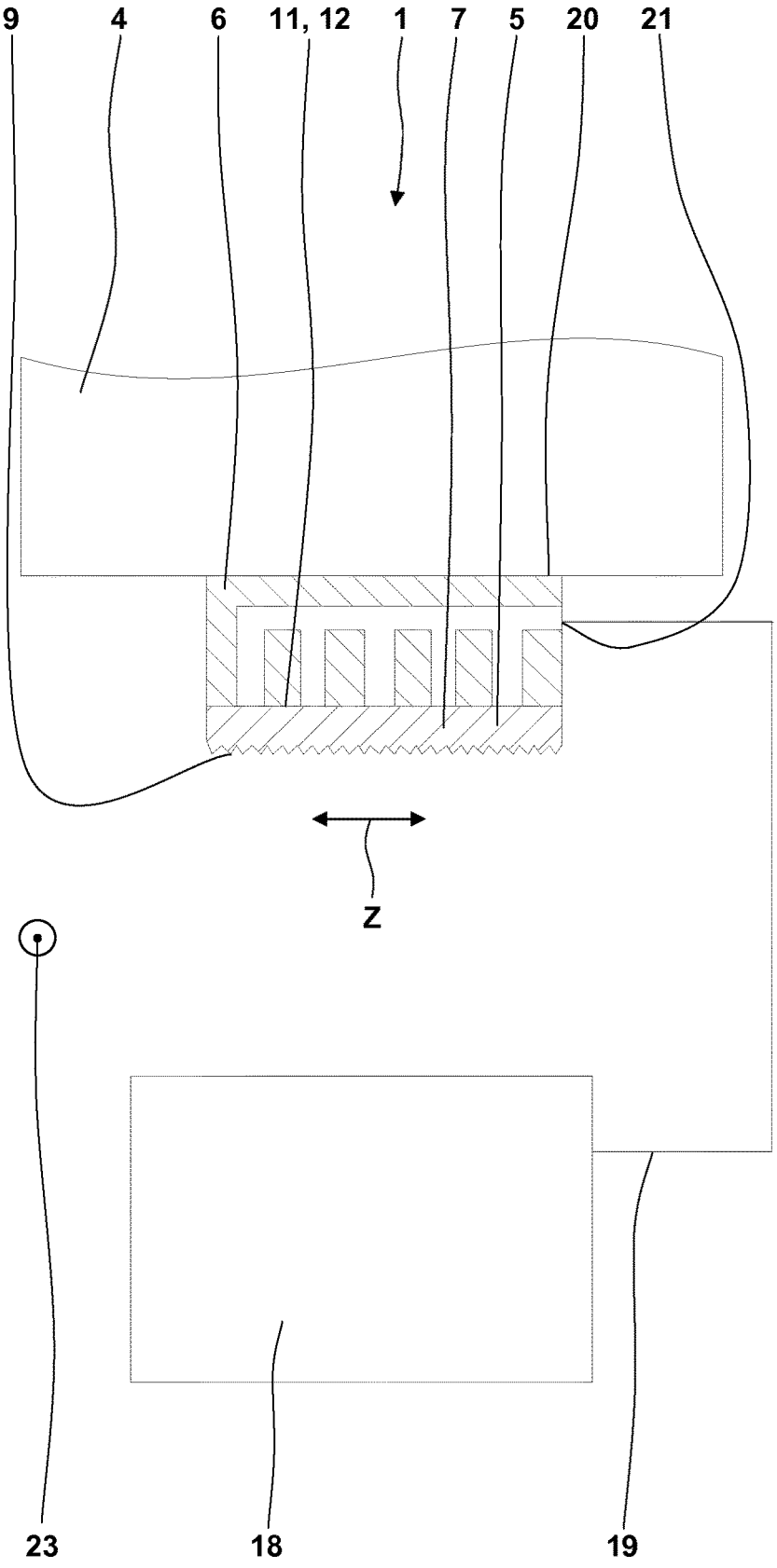
FIG. 4 shows a partially sectioned schematic view of a further exemplary embodiment of the new rolling machine with a negative pressure connection.

FIG. 4 illustrates further details of the embodiment of the rolling machine 1 having a negative pressure connection 21 for realizing negative pressure connection.

The rolling machine 1 has a negative pressure source 18 which is connected to the negative pressure connection 21 via a negative pressure line 19. The negative pressure connection 21 is connected to the negative pressure duct 17. Negative pressure is generated via the negative pressure source 18, the negative pressure line 19, the negative pressure connection 21 and the negative pressure duct 17 in such a way that the desired connection between the basic body 6 and the profiled part 7 of the rolling tool 5 is achieved.

Figure 5:
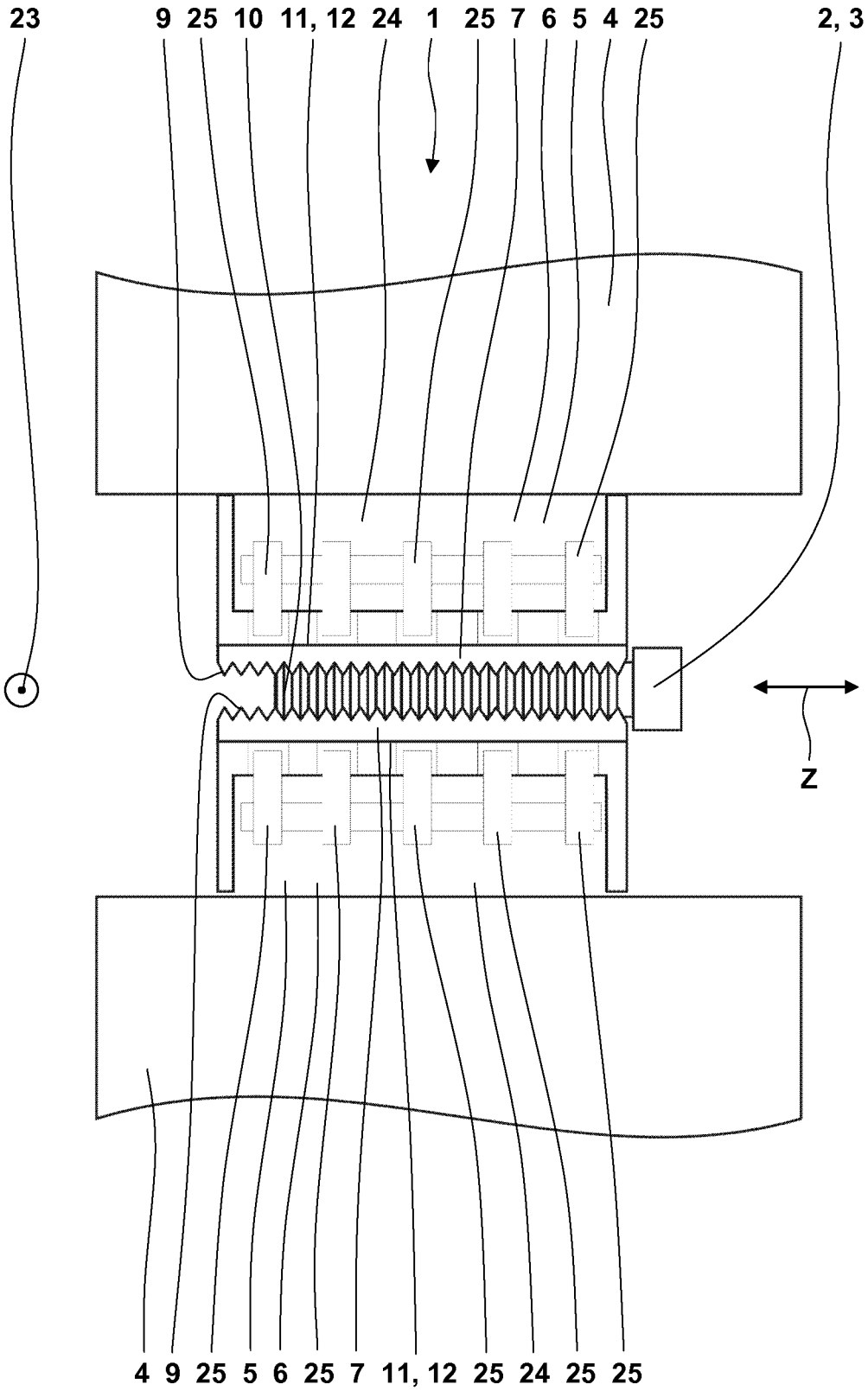
FIG. 5 shows a schematic view of a pair of a further exemplary embodiment of the new rolling tool having magnet holders.

FIG. 5 illustrates a view of the rolling machine 1 according to FIG. 1 from the right such that the workpiece in the form of a screw 3 and the profile-imparting portions 9 are better visible. However, by comparison with FIG. 1, a connecting technique is illustrated here. Also shown is a position adopted later in time in the rolling operation in order to be able to show the formation of the thread 10 of the screw 3. The thread 10 has been illustrated in simplified form in that the pitch typical for a thread has not been taken into consideration in the drawing. However, it will be appreciated that what is concerned is a standard thread with a pitch. With regard to the corresponding aspects of the illustration of FIG. 2 and the following figures, reference is made to the above-indicated description of FIG. 1 for the purpose of avoiding repetitions.

In the present example, each of the rolling tools 5 has a connecting means which is formed as a magnet holder 24. The magnet holder 24 has a plurality of magnets 25 which are arranged in corresponding cutouts in the basic body 6. The magnets 25 ensure the desired floating mounting between the basic body 6 and the associated profiled part 7. Here, the basic body 6 can be formed either as part of the rolling machine 1 in the sense of being integrated into the latter or as an add-on part to the rolling machine 1.

Figure 6:
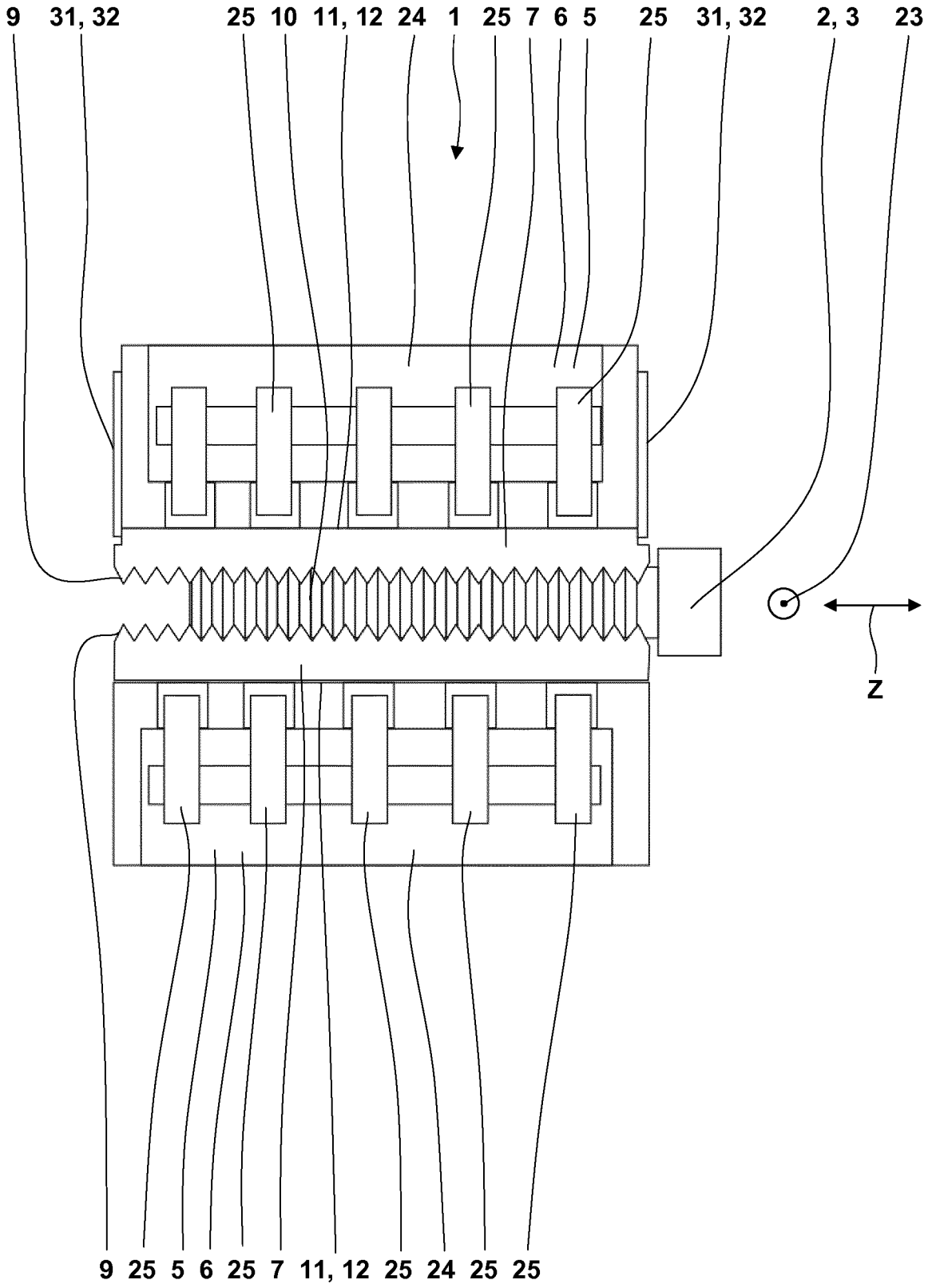
FIG. 6 shows a schematic view of a pair of a further exemplary embodiment of the new rolling tool having magnet holders and springs.

FIG. 6 shows a further exemplary embodiment of the rolling tool 5 of the rolling machine 1. In this case, the connection between the basic body 6 and the profiled part 7 is again realized by the magnet holders 24.

However, these are supplemented by springs 31 formed here as disk springs 32. They are fastened to the basic body 6, in particular by screw connections. However, they could also be other suitable springs 31. In this way, the desired play is realized such that the profiled part 7 can move relative to the basic body 6 in the plane perpendicular to the rolling direction 23.

Figure 7:
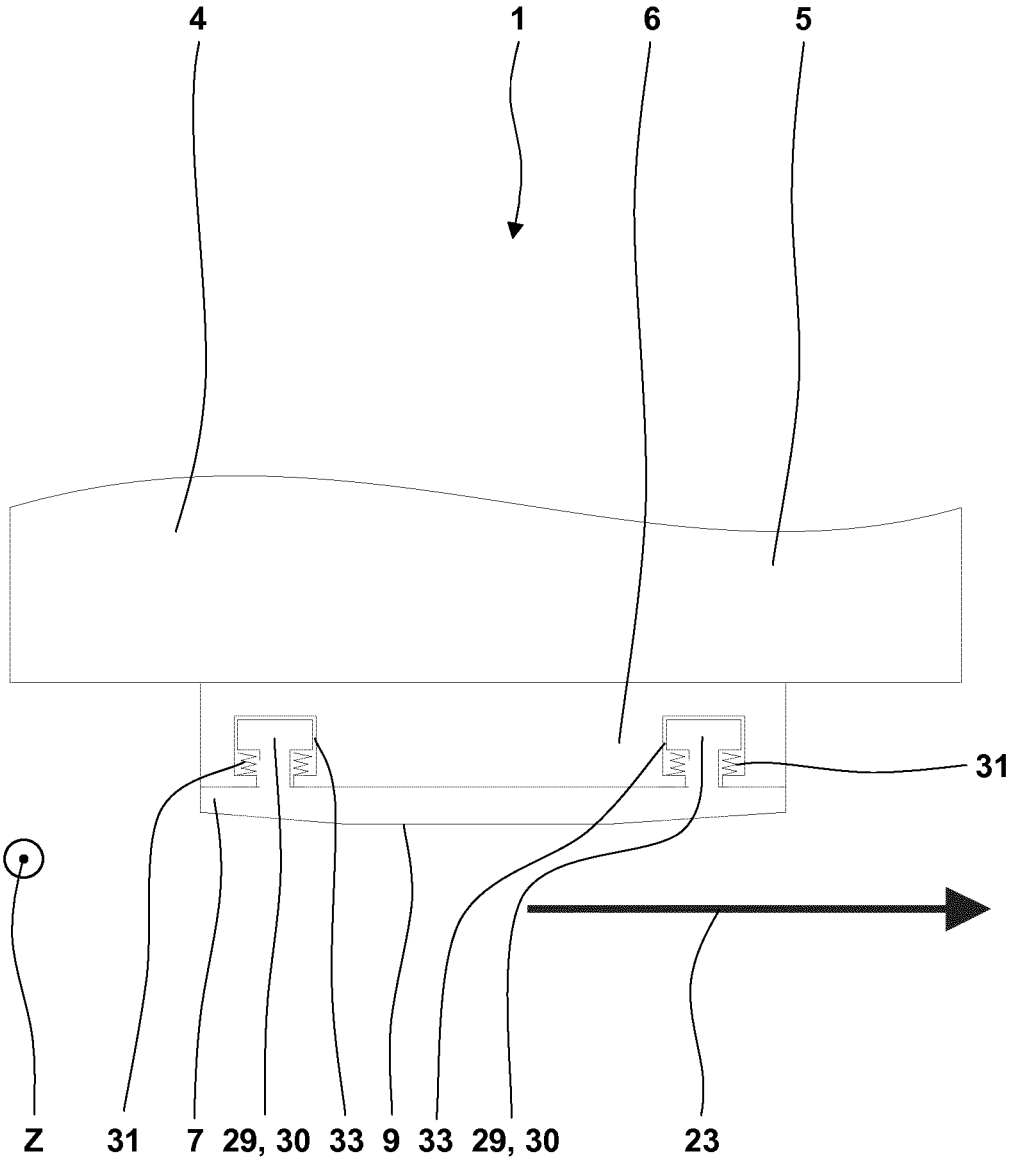
FIG. 7 shows a schematic side view of a part of a further exemplary embodiment of the new rolling machine having two rolling tools with a tongue and groove connection at the start of the shaping treatment of a workpiece to be rolled.

FIG. 7 shows a further exemplary embodiment of the rolling tool 5 of the rolling machine 1. In this case, the connection between the basic body 6 and the profiled part 7 is realized by two form-fitting connecting elements 29. What is concerned here is a tongue and groove connection 30 having an (exaggeratedly illustrated) play 33 between the groove and the tongue. There thus results a clearance fit such that the profiled part 7 can move relative to the basic body 6 in the plane perpendicular to the rolling direction 23 along the movement axis Z. Here, the profiled part 7 is held on the basic body 6 by means of the springs 31.

Figure 8:
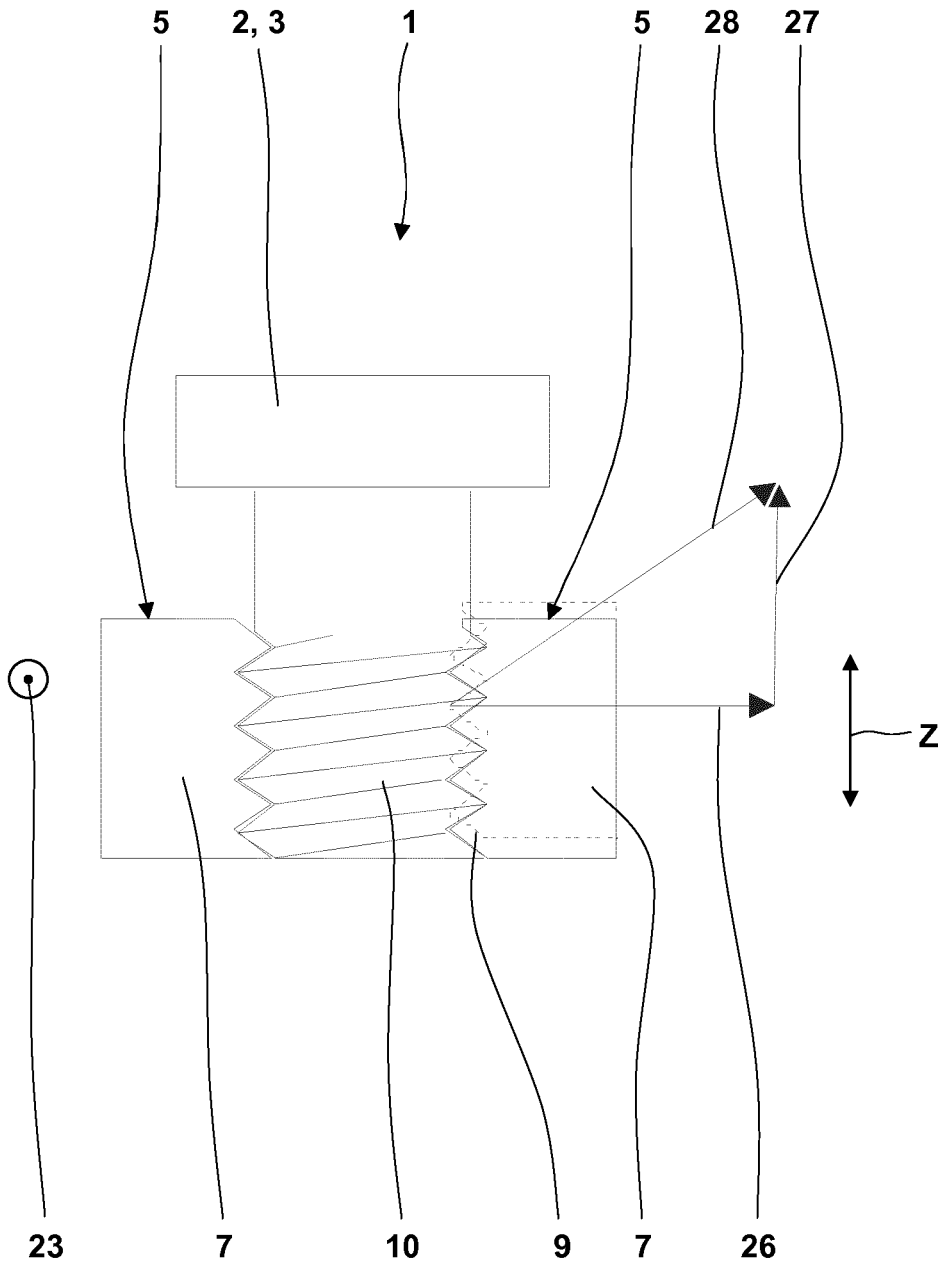
FIG. 8 shows a schematic view of a pair of rolling tools having a profiled part, which is movably mounted relative to its associated basic body, with a first tracking error.
Figure 9:
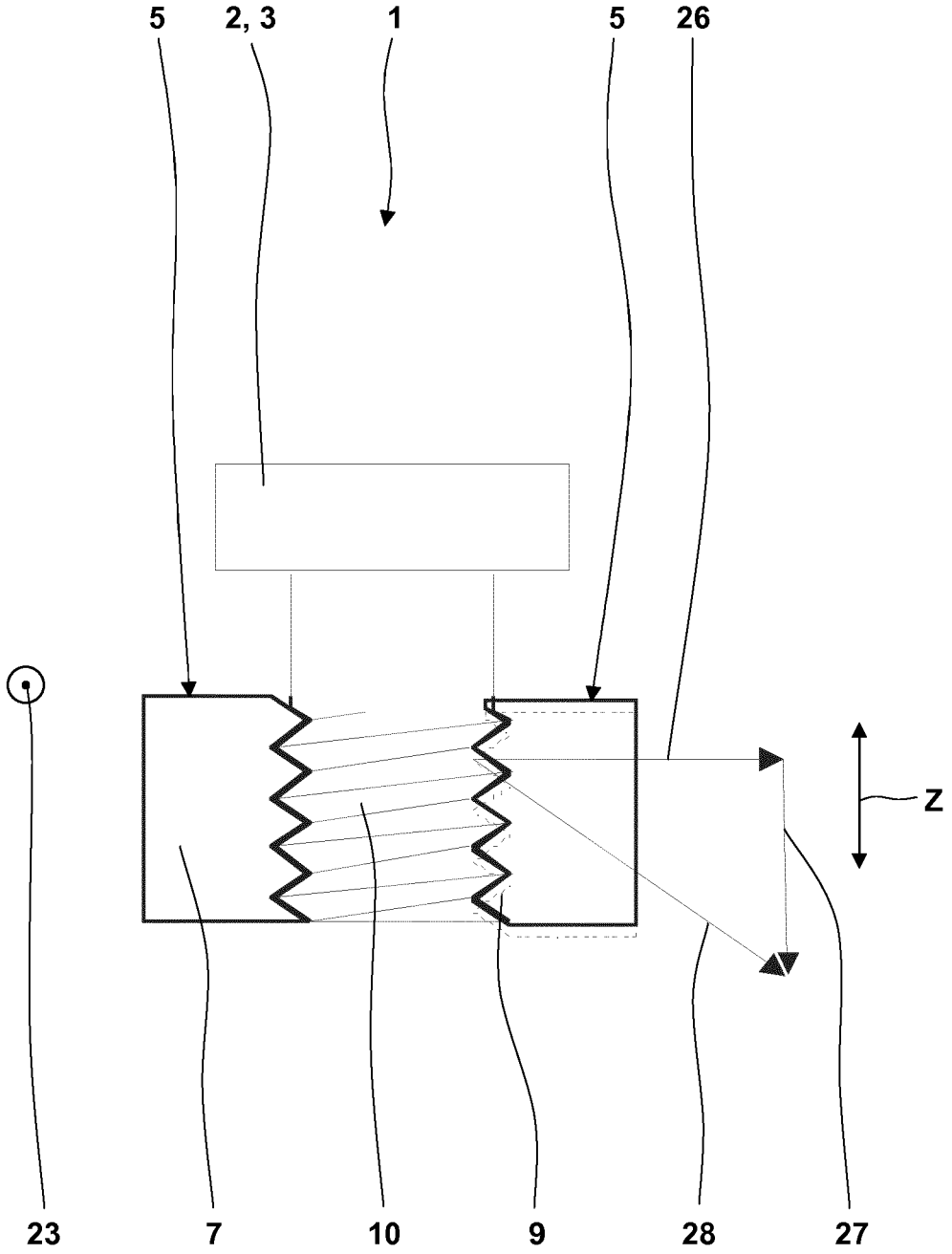
FIG. 9 shows a schematic view of the pair of rolling tools according to FIG. 8 with a second tracking error.
Figure 10:
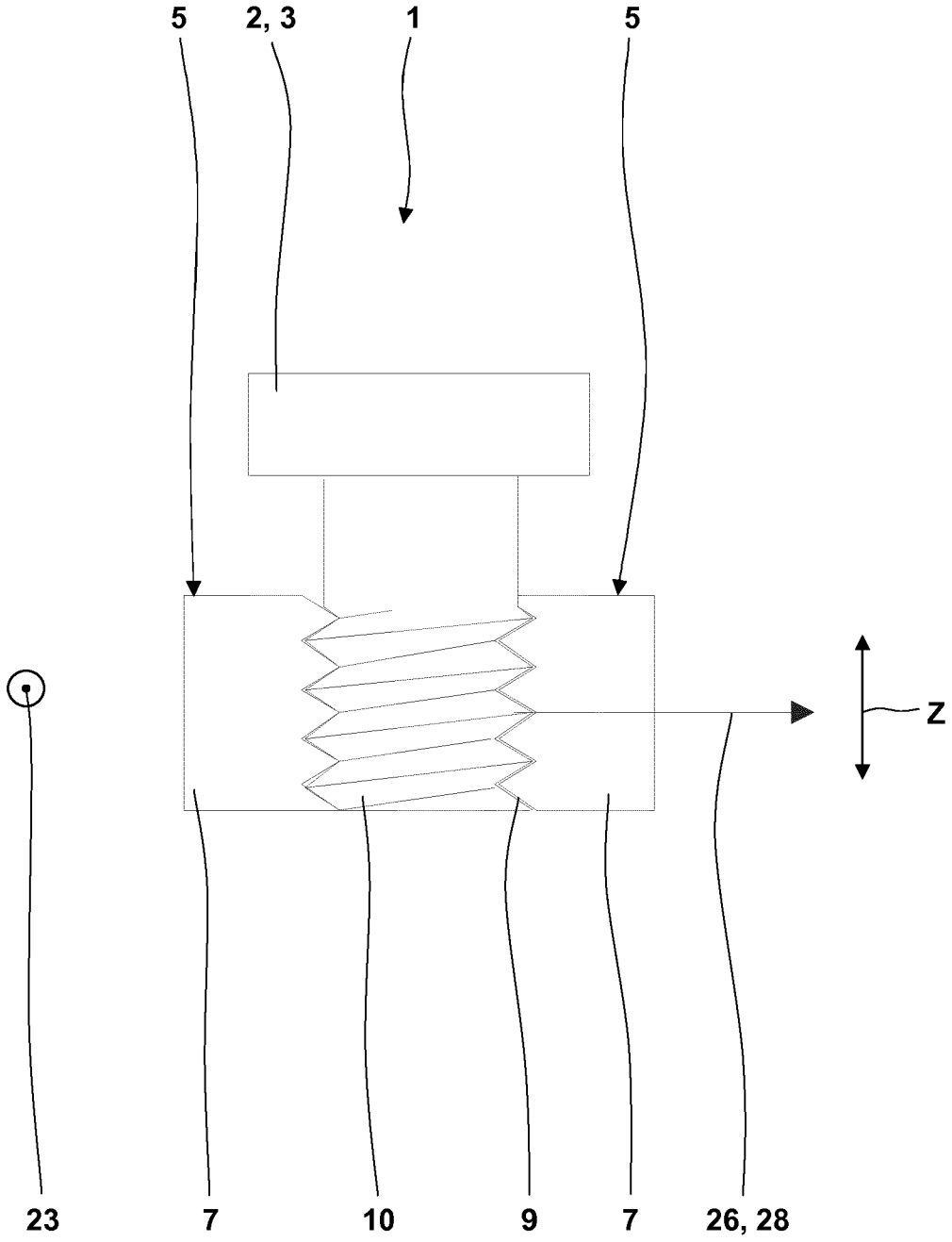
FIG. 10 shows a schematic view of a pair of rolling tools according to FIG. 8 in the aligned position without tracking error.

FIGS. 8, 9 and 10 are schematic views showing different relative positions between the rolling tools 5 of a pair of rolling tools 5 in order to more precisely explain the self-adjustment achieved by the floating mounting. In the example illustrated, only the profiled part 7 illustrated on the right is floatingly mounted and thus carries out the alignment. However, it is also possible that both profiled parts 7 are floatingly mounted and jointly carry out the alignment. The force components resulting during the rolling operation are illustrated in the figures by arrows. With the profiled parts 7 correctly aligned with one another, only the horizontal force 26 occurs.

It is evident in FIG. 8 that a deviation between the thread 10 and the profile-imparting portion 9 (see dashed line) of the profiled part 7 illustrated on the right is present. This deviation concerns the movement axis Z.

Present in addition to the horizontal force 26 is the upwardly directed tracking error force 27, thereby producing the obliquely upwardly directed resulting force 28. If the rolling operation were continued with this relative alignment, the thread 10 of the screw 3 would be incorrectly formed.

FIG. 9 illustrates the other kind of a tracking error. In this case, the tracking error force 27 is directed downwardly. The horizontal force 26 and this tracking error force 27 thus produce the obliquely downwardly directed resulting force 28. This alignment also gives rise to an incorrect formation of the thread 10.

FIG. 10, however, now illustrates the position of the profiled parts 7 of the pair of rolling tools 5 that automatically results on account of the floating mounting of the profiled part 7 illustrated on the right. In the course of the rolling process, the profiled parts 7 of the pair of rolling tools 5 are automatically aligned with one another. This is possible on account of the translational degree of freedom, which is provided by the floating mounting, in the plane illustrated in FIG. 9 along the movement axis Z. This movement axis Z extends perpendicular to the rolling direction 23. There is thus no longer present any tracking error, and therefore the horizontal force 26 corresponds simultaneously to the resulting force 28 and the thread 10 is correctly formed.

Figure 11:
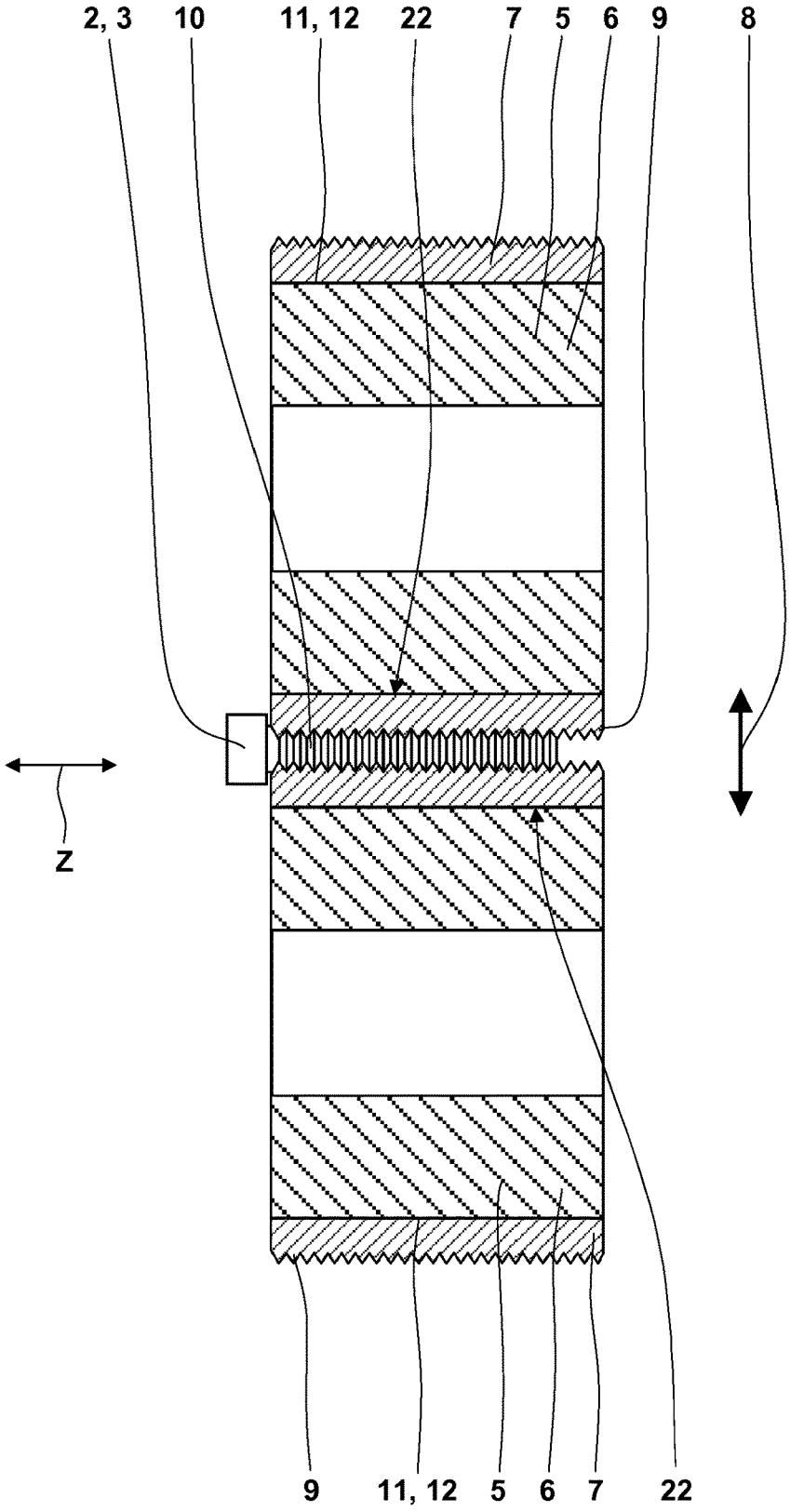
FIG. 11 shows a sectional view of a further exemplary embodiment of the new rolling tools.

FIG. 11 illustrates a further exemplary embodiment of a pair of rolling tools 5. In this case, the rolling tools are not formed as parallelepipedal or plate-shaped rolling jaws but as cylindrical rollers. These rollers here again for example produce the thread 10 of the screw 3. For an illustration of the thread 10, reference is made to the above-indicated statements for FIG. 2. In this example, the connecting portions 11, 12 are cylindrical surfaces which are connected to one another in a suitable manner. The movable connection is not further illustrated in this drawing. However, reference is analogously made in this respect to the above-indicated statements.

Figure 12:
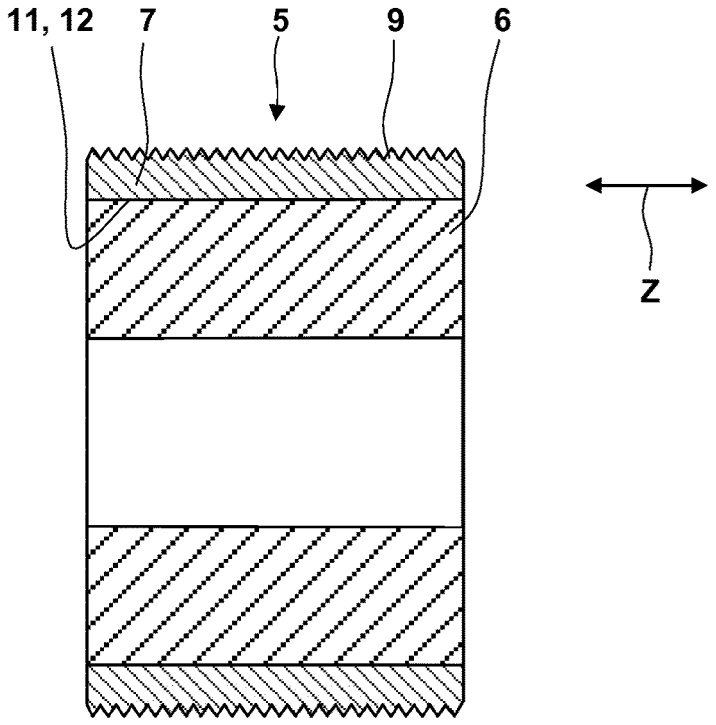
FIG. 12 shows one of the rolling tools from FIG. 11.
Figure 13:
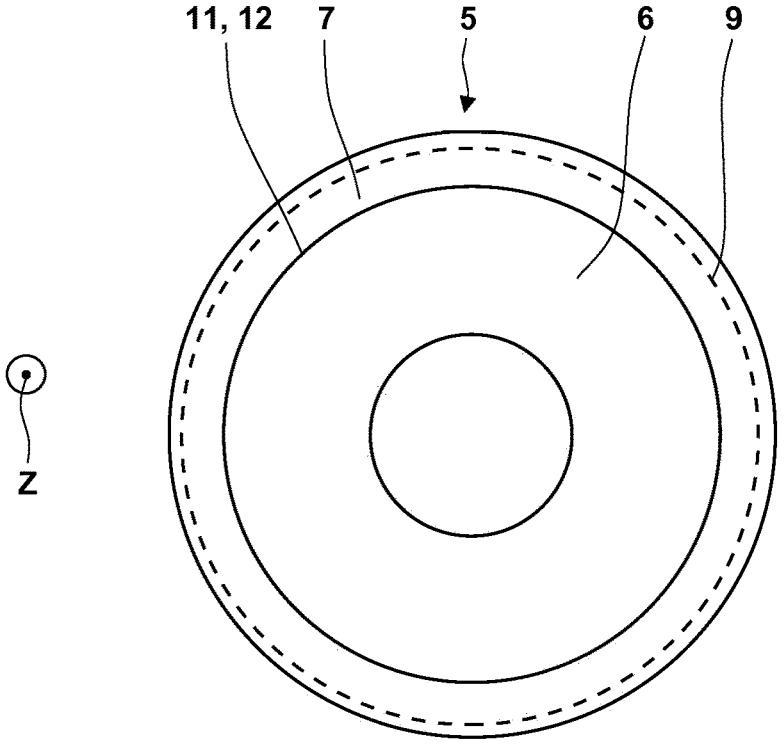
FIG. 13 shows a side view of the rolling tool according to FIG. 10.

FIGS. 12 and 13 show one of the rolling tools 5 from FIG. 8 in two different views. Particularly evident here is the cylindrical design of the connecting portions 11 and 12.

Figure 14:
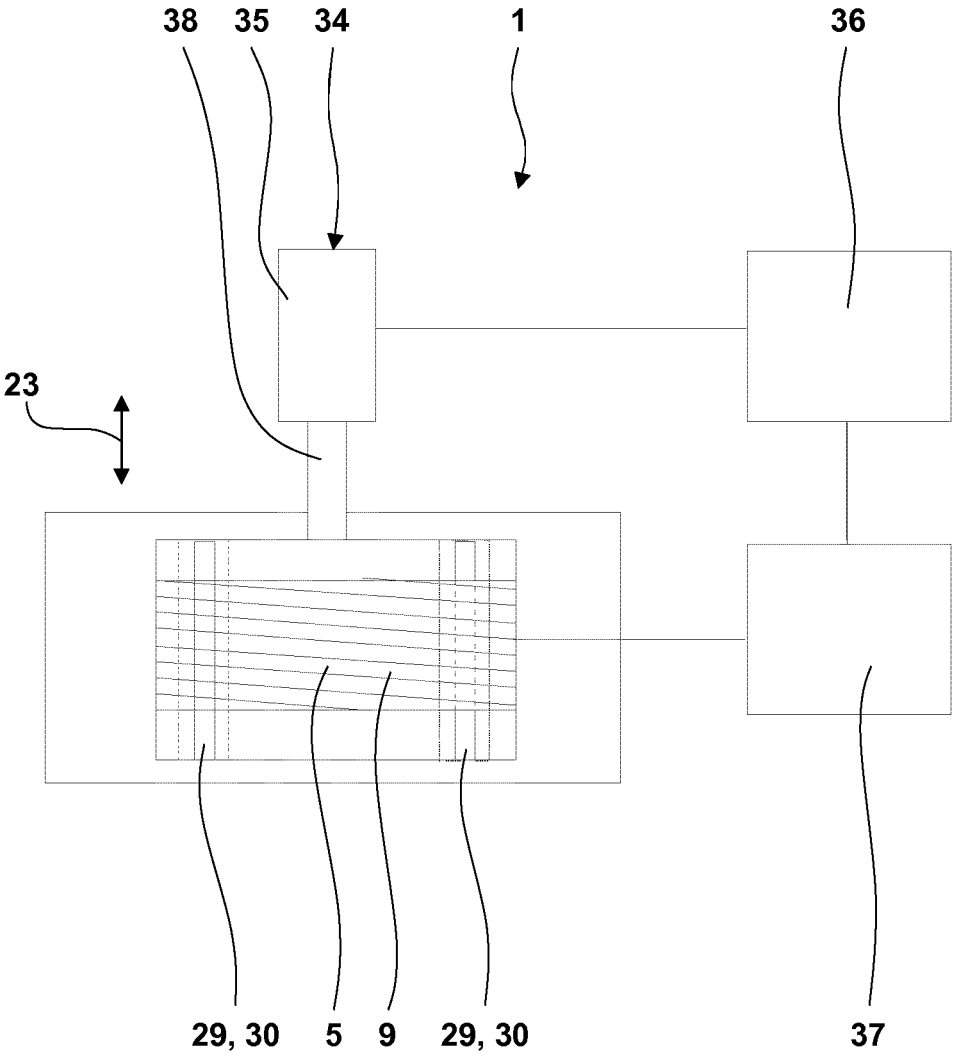
FIG. 14 shows a schematic plan view of a further exemplary embodiment of the new rolling tools having a movement drive.

FIG. 14 shows a schematic plan view of a further exemplary embodiment of the rolling tools 5. In this case, they have a movement drive 34. The movement drive 34 has a motor 35, a motor controller 36, a movement sensor unit 37 and a coupling element 38. The movement drive 34 serves to support the relative movement between the profiled part 7 and the basic body 6 in a motorized manner. The coupling element 38 is operatively connected to the profiled part 7. The motor 35 drives the coupling element 38 rotationally or translationally back and forth. This movement is transmitted by the coupling element 38 to the profiled part 7 and thus brings about the desired translational movement of the profiled part 7 relative to the basic body 6.

The movement drive 34 has a movement sensor unit 37. The movement sensor unit 37 detects a relative movement between the profiled part 7 and the basic body 6 that automatically results from the rolling operation and increases said relative movement. As soon as the tracking error force is no longer present or a limit value is undershot, the motor 35 is switched off. If the tracking error force changes its sense of direction, the rotation sense of direction of the motor 35 is reversed.

Figure 15:
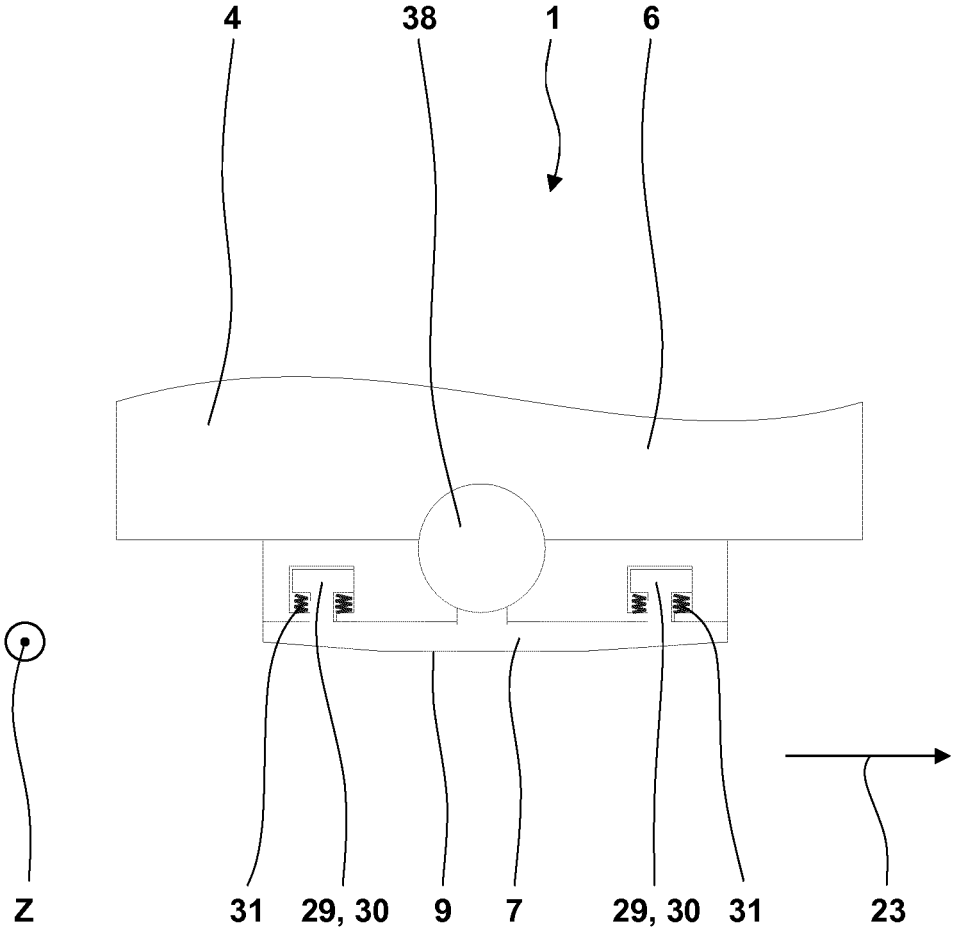
FIG. 15 shows a schematic side view of one of the rolling tools according to FIG. 14.

FIG. 15 schematically shows the connection between the coupling element 38 and the profiled part 7 of the rolling tool 5 according to FIG. 14.

Figure 16:
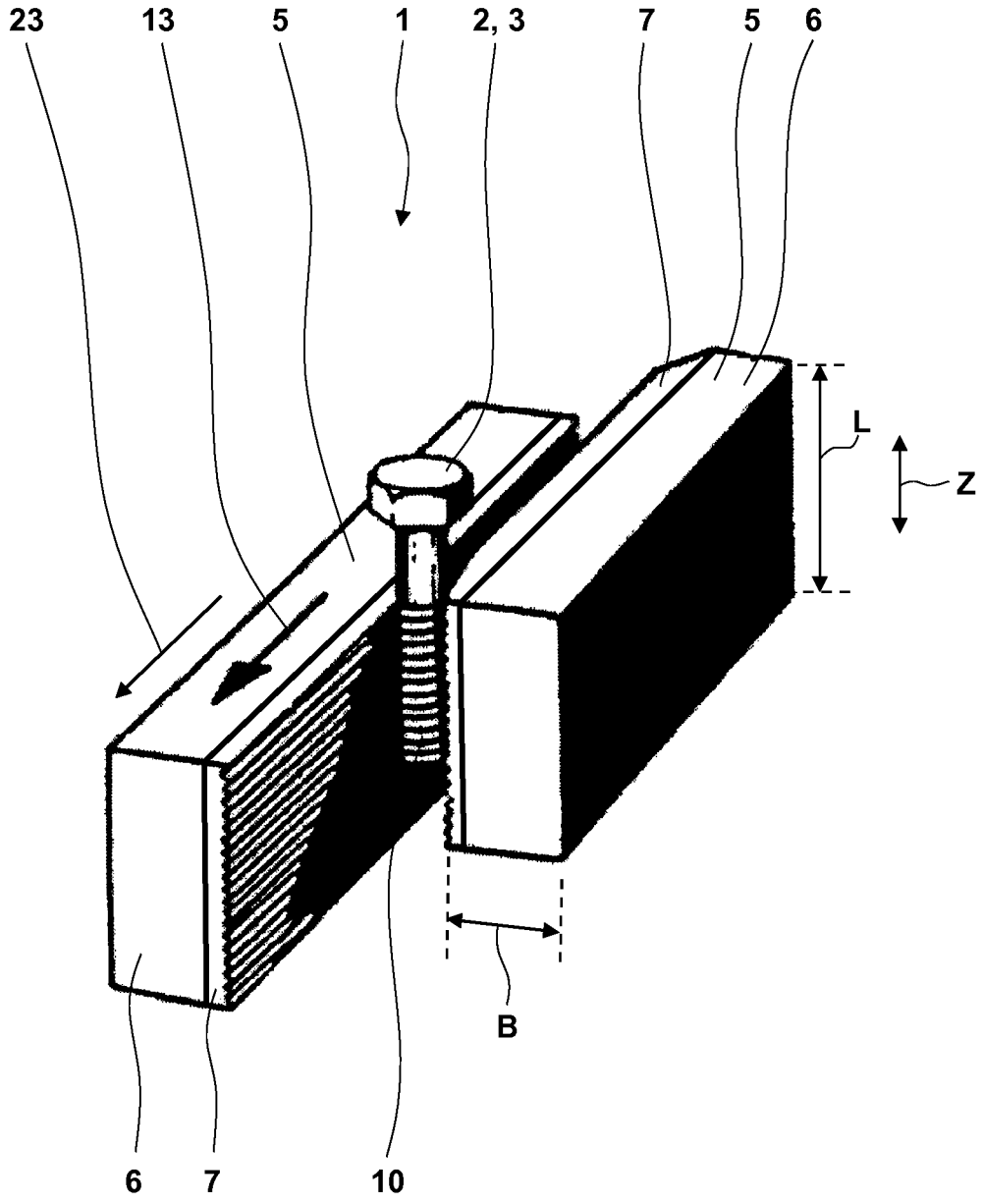
FIG. 16 shows a perspective view of an exemplary embodiment of the new rolling tools for explaining the geometric conditions.

FIG. 16 shows a perspective view of an exemplary embodiment of the new rolling tools 5 to explain the geometric conditions. Here, the left rolling tool 5 is movable and the right rolling tool 5 is fixed. It is clearly evident how the movement axis Z extends relative to the rolling tool 5 and the workpiece 2 in the form of a screw 3.

LIST OF REFERENCE SIGNS

1 Rolling machine
2 Workpiece
3 Screw
4 Mount
5 Rolling tool
6 Basic body
7 Profiled part
8 Radial direction
9 Profile-imparting portion
10 Thread
11 Connecting portion
12 Connecting portion
13 Arrow
17 Negative pressure duct
18 Negative pressure source
19 Negative pressure line
20 Fastening portion
21 Negative pressure connection
22 Connecting means
23 Rolling direction
24 Magnet holder
25 Magnet
26 Horizontal force
27 Tracking error force
28 Resulting force
29 Form-fitting connecting element
30 Tongue and groove connection
31 Spring
32 Disk spring
33 Play
34 Movement drive
35 Motor
36 Motor controller
37 Movement sensor unit
38 Coupling element

The invention claimed is:

1. A rolling machine (1) tool (5), comprising a basic body (6) for fastening a rolling tool (5) in the rolling machine (1), a profiled part (7) for the shaping treatment of a workpiece (2) to be rolled, wherein the basic body (6) and the profiled part (7) are a multi-piece structure and structured such that they can be connected to one another and nondestructively separated from one another, wherein the basic body (6) and the profiled part (7), in their interconnected position, are mounted movably relative to one another in a plane perpendicular to the rolling direction (23) while exclusively overcoming static friction between them, and wherein, in the operating position of the rolling tool (5) in the rolling machine (1), the basic body (6) and the profiled part (7) are structured such that they can be connected to one another by negative pressure, magnetism, and/or spring force.

2. The rolling machine (1) as claimed in claim 1, wherein the degree of the movability along only one axis in the plane perpendicular to the rolling direction (23) is between 0.1 mm and 0.3 mm.

3. The rolling machine (1) as claimed in claim 1, wherein the profiled part (7) is structured as a threaded rolled part with a pitch, and a degree of the movability along only one axis in the plane perpendicular to the rolling direction (23) is between 5% and 15% of the pitch.

4. The rolling machine (1) as claimed in claim 1, wherein the basic body (6) and the profiled part (7), in their interconnected position, are mounted movably relative to one another in the plane perpendicular to the rolling direction (23) along only one axis, namely a movement axis (Z).

5. The rolling machine (1) as claimed in claim 4, wherein the profiled part (7) has a length (L) and a width (B), wherein the rolling direction (23) extends parallel to the length (L) of the profiled part (7), and wherein the movement axis (Z) extends parallel to the width of the profiled part (7).

6. The rolling machine (1) as claimed in claim 4, wherein the movement axis (Z) corresponds to the longitudinal axis of a workpiece (2) to be rolled which is received in the rolling tool (5).

7. The rolling machine (1) as claimed in claim 1, wherein the basic body (6) and the profiled part (7) are movably connected to one another such that, after a relative movement, they are not urged back into a starting position by a resetting means.

8. The rolling machine (1) as claimed in claim 1, wherein the profiled part (7) has a smaller thickness than the basic body (6) and/or of 10 mm or less.

9. The rolling machine (1) as claimed in claim 1, wherein a maximum thickness of the profiled part (7) is between 4 mm and 10 mm.

10. The rolling machine (1) as claimed in claim 1, wherein the profiled part (7) is arranged on the basic body (6) as seen in the radial direction (8) of the workpiece (2) to be rolled, and/or wherein the profiled part (7) has a profile-imparting portion (9) for the shaping treatment of the workpiece (2) to be rolled and a connecting portion (11) for connection to the basic body (6), and/or wherein the basic body (6) has no profile-imparting portion for the shaping treatment of the workpiece (2) to be rolled, but a fastening portion (20) for fastening in a rolling machine (1) and a connecting portion (12) for connection to the profiled part (7), and/or wherein the rolling tool (5) is structured as a rolling jaw.

* * * * *